US008721385B2

(12) United States Patent
Karsten et al.

(10) Patent No.: US 8,721,385 B2
(45) Date of Patent: May 13, 2014

(54) POSE ABLE TOY AND METHOD FOR INTERCONNECTION

(76) Inventors: Lisa McCue Karsten, Annapolis, MD (US); Kenneth Stephen Karsten, Jr., Annapolis, MD (US)

( * ) Notice: Subject to any disclaimer, the term of this patent is extended or adjusted under 35 U.S.C. 154(b) by 146 days.

(21) Appl. No.: 13/078,904

(22) Filed: Apr. 1, 2011

(65) Prior Publication Data

US 2012/0252308 A1 Oct. 4, 2012

(51) Int. Cl.
*A63H 33/00* (2006.01)

(52) U.S. Cl.
USPC ..... 446/97

(58) Field of Classification Search
USPC ..... 446/97, 99, 100
See application file for complete search history.

(56) References Cited

U.S. PATENT DOCUMENTS

| | | | | |
|---|---|---|---|---|
| 4,614,505 | A * | 9/1986 | Schneider et al. | 446/372 |
| 7,354,330 | B2 * | 4/2008 | Bentley, Jr. | 446/102 |
| 2012/0214380 | A1 * | 8/2012 | Vine, III | 446/121 |

* cited by examiner

*Primary Examiner* — Gene Kim
*Assistant Examiner* — Amir Klayman
(74) *Attorney, Agent, or Firm* — 24IP Law Group; Timothy R DeWitt

(57) ABSTRACT

This method of interconnection utilizes aesthetic features of the toy itself to alloy interconnection in a safe and secure way, without the use of snaps and pins that can cause a safety hazard to young children. The proposed method also allows for interconnection of multiple toys to create a toy chain as well as an adapter that allows for toys that embody this feature to be connected to clothing, back packs, shoes as an accessory. By extension of this basic interconnection method, any two or more objects can be connected this same way.

6 Claims, 3 Drawing Sheets

Perspective view of Jibballs in a sequence of connection.

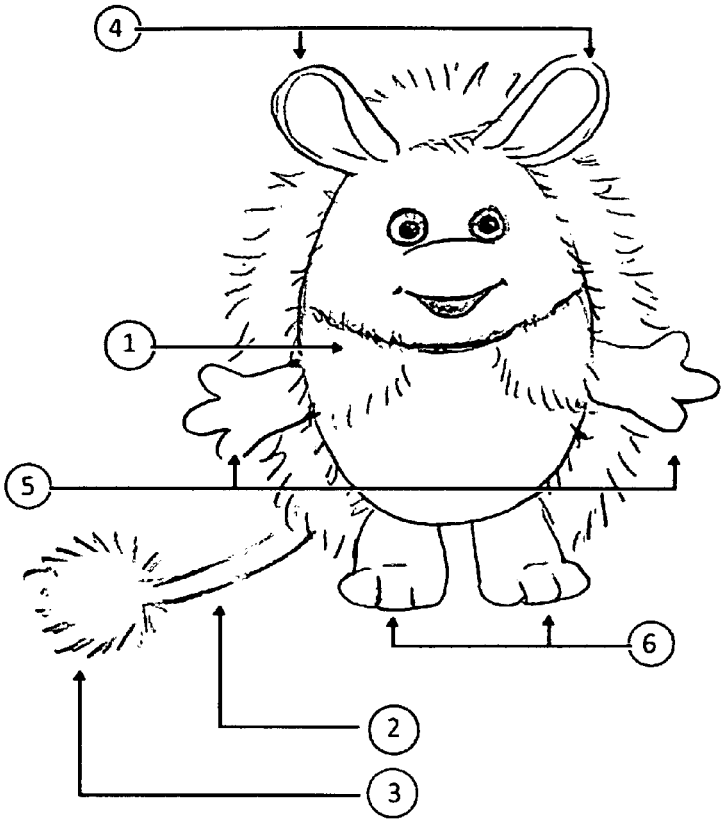
Figure 1, Front view of a Jibball showing the 3 basic elements needed for the first connection.

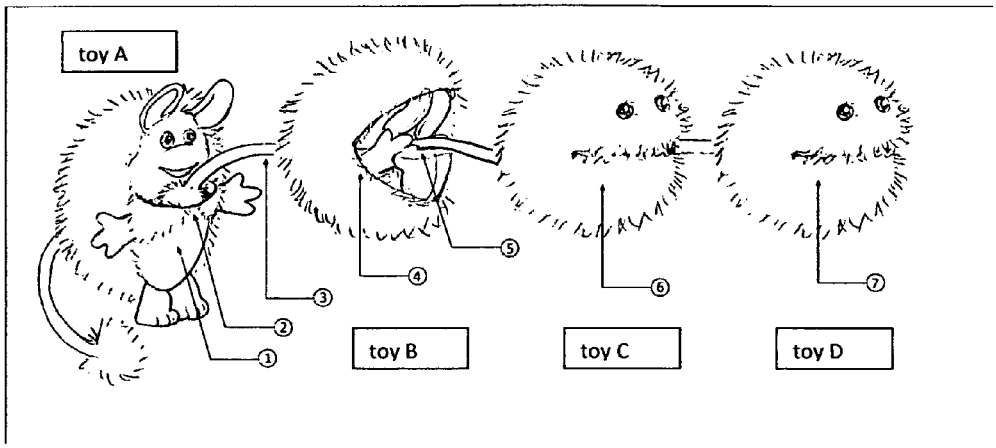
Figure 2, Perspective view of Jibballs in a sequence of connection.
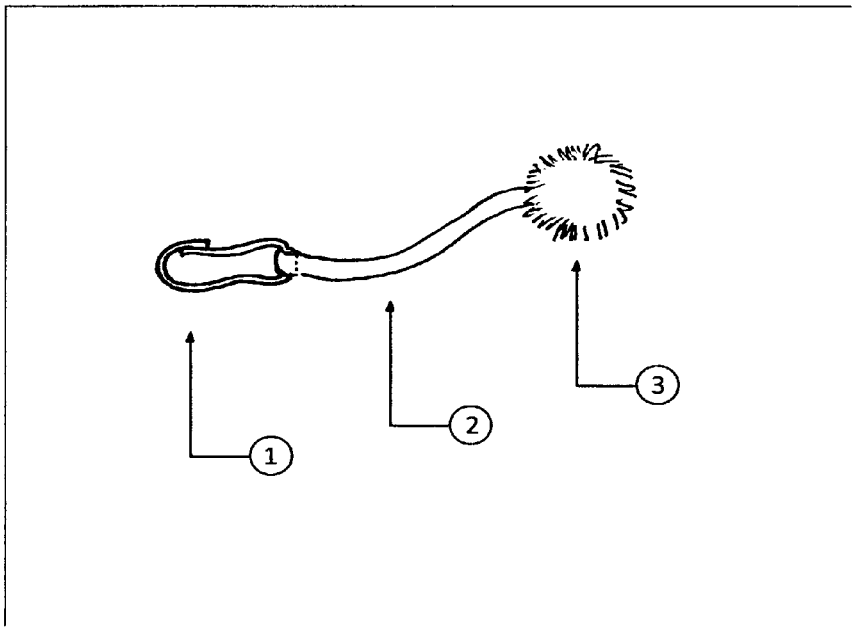
Figure 3, Perspective view of the accessory connection tail.

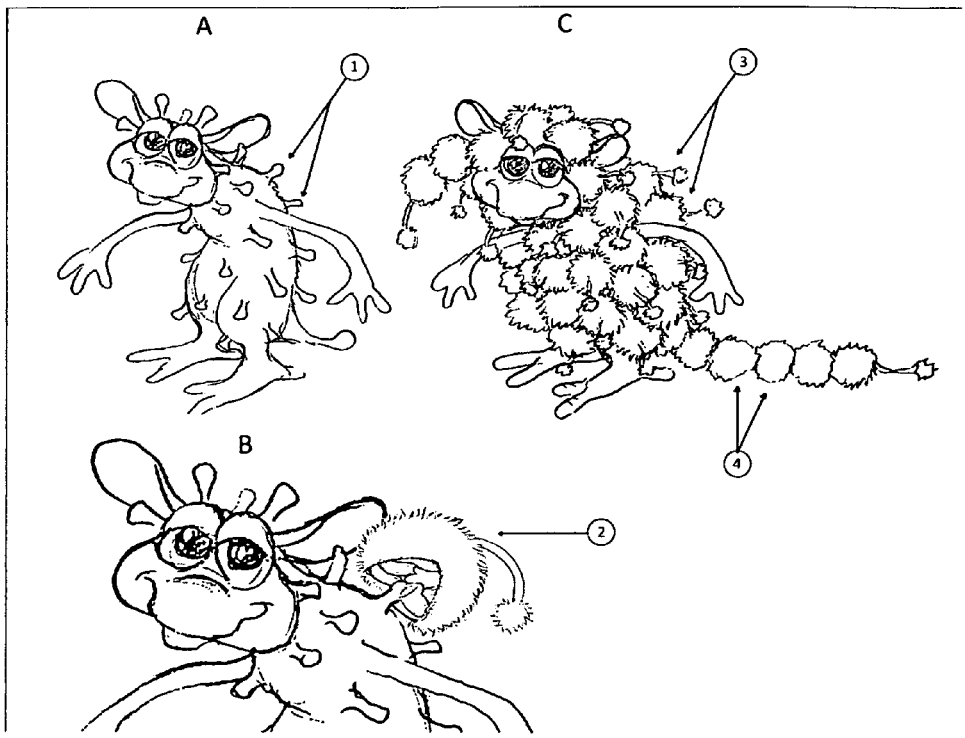
Figure 4, Perspective view of a nub.

POSE ABLE TOY AND METHOD FOR INTERCONNECTION

CROSS-REFERENCE TO RELATED APPLICATIONS

None.

STATEMENT REGARDING FEDERALLY SPONSORED RESEARCH OR DEVELOPMENT

None.

REFERENCE TO SEQUENCE LISTING, A TABLE, OR A COMPUTER PROGRAM LISTING COMPACT DISC APPENDIX

None.

BACKGROUND OF THE INVENTION

Applicable to plush, plastic, rubber and other toys, and extendable to connection of any two similar objects, this method of interconnection utilizes aesthetic features of the toy itself to alloy interconnection in a safe and secure way, without the use of snaps and pins that can cause a safety hazard to young children. The proposed method also allows for interconnection of multiple toys to create a toy chain as well as an adapter that allows for toys that embody this feature to be connected to clothing, back packs, shoes as an accessory. By extension of this basic interconnection method, any two or more objects can be connected this same way.

BRIEF SUMMARY OF THE INVENTION

Well known Children's book author, illustrator and artist, Lisa McCue has created a plush toy animal that starts formed as a ball and can open and transforms into a friendly fun creature named "Jibballs". The Jibball embodies the invention and will be used to describe the Pose able Toy and Method for Interconnection by example.

Jibballs are made of multiple colors of fake fur, felt, wire (or other methods of posing plush toys known in the art), buttons, plastic eyes, thread, cotton or poly fill & similar materials. Jibballs are a beautifully designed, plush toy that introduces several unique features: Pose able in any position from a ball to fully open with a pom pom tail in either position out the back. When closed, Jibballs are a furry, round ball with two eyes and a tail with a furry pom-pom at the end of the tail. When opening, the ball is transformed to a creature with ears, legs, arms, body with pouch and captivatingly friendly face. What was the furry ball closed, becomes the colorful furry back of the Jibballs body with eyes in the back of it's head (FIG. 1).

The claimed invention is embodied in Jibballs, by example, in that they can be linked together forming a chain of Jibballs (FIG. 2). This is done by, first, insert and tuck the pom-pom tip of the tail of Jibball (2) into the pouch of Jibball (1), then, fold in the ears, arms, legs and close Jibball (1) over the tail of Jibball (2), now those two Jibballs are linked together. Further, insert and tuck the pom-pom tip of the tail of another Jibball (3) into the pouch of Jibball (2), then close Jibball 2 over the tail of Jibball 3, now all three Jibballs are linked together.

Jibballs can be linked to almost anything with the connector accessory (FIG. 3). The connector accessory is a Jibball tail with a pom-pom on one end and a loop string on the other, The loop string can be attached to a zipper (jacket, backpack) or a shoe lace run through it, or looping back on itself around any opening (button hole, etc).

BRIEF DESCRIPTION OF THE SEVERAL VIEWS OF THE DRAWING

FIG. 1 is a front view of a Jibball showing three basic elements needed for the first connection between two toys.

FIG. 2 is a perspective view of Jibballs in a sequence of connection. This figure shows how the basic elements needed for connection are implemented, by example of a Jibball, as well as how that connection is strengthened by second step or connection, the novel use of a new belay device that is formed when the first Jibball (toy or object) is closed over the tail of the second.

FIG. 3 is a perspective view of the accessory connection tail. This figure shows how the a Jibball or similarly constructed toy or object can be connected to any other toy, object, article of clothing, back packs etc, by connecting the toy to the accessory connection tail, then connecting the accessory connection tail to the other object, by a variety on known methods.

FIG. 4 is a perspective view of a nub, an example of how a toy constructed similarly to a Jibball can connect, with this basic method, to another toy incorporating the tail feature.

DETAILED DESCRIPTION OF THE INVENTION

The Pose Able Toy and Method for Interconnection with another toy or accessory need to have three basic elements to function. Referring to FIG. 1, the first toy needs to embody a pouch or pocket (FIG. 1-1) that a second toy can have a tailor extension (FIGS. 1-2 & 3) placed into. The extension of the second toy can be a tail (FIG. 1-2) with, or without a pom-pom (FIG. 1-3), as in the Jibball example, or a straight tail, tail tapered to a narrower end or wider end, or one that can be partially rolled up to form a ball or pom-pom shape, or be formed in a similar shape like a tear drop or beaver tail. Thirdly, the first toy or object needs to close over the tailor extension of toy 2 holding the tailor extension in the pocket and fold over the pocket to make a firm connection. Additionally, to increase the strength of the connection, the first toy needs to incorporate features, such as foldable, ears, arms and legs, (FIGS. 1-4, 5 & 6) or other protrusions that also fold in over the second toy pom-pom and or tail when being closed to hold the pom-pom and or tail of the second toy in place. Alternatively, the pom-pom (FIG. 1-3), tear drop shape or beaver tail widening on the end of a tailor extension can be slightly larger than the pouch or pocket (FIG. 1-1) opening when fully relaxed. It must also be made of a compressible material that, when compressed, is smaller than the pocket or pouch opening such the insertion is simple and easy for a young child to accomplish. Once released, the pom-pom or similar shape will extend to a size slightly larger than the pocket opening, forming the first connection of the two toys. In this alternate case, foldable extensions (in this case; ears, arms or legs) are not necessary to form a good first connection. The pocket must be large enough to allow the tail end (FIG. 1-3) expand to relaxed size.

The force required to pull the pom-pom (FIG. 2-2), tail or similar extension of toy B or similar out of the pocket of toy A (FIG. 2-1) is increased by folding the tailor extension of toy B over the pocket of toy 1 as it exits toy A, then closing toy A over the exiting tail of toy B (FIGS. 2-4 & 5) and FIGS. 2-6) holds this folded position, essentially putting connected toy B "on belay" with toy A (a technique used in mountain climbing to greatly reduce the forces on a climbing line from the climber to the belay person). In this case, the pocket and closing of the pocketed toy over the extension from the connected toy, essentially form a new type of belay device. Here, no clips, snaps or pins are used to make the connection more secure. Just proper sizing, shaping and placement of soft safe toy materials to within another toys pouch or pocket, using materials and posing mechanisms proven in the prior state of the art for toy making.

An example another type of toy or object embodying the tear drop shape is the nub (FIG. 4), where the entire body of the nub is covered in protrusions in the shape of a tear drop. The Jibball, or similar closing toy or object with a pouch or pocket connects to the nub (by example) by having the tear drop extension placed into the pocket or pouch and the interconnecting toy or object closes over the tear drop extension. Mechanisms to form a pocket or pouch, etc. and pose or close the toy is embodied in prior art. This clamping method can be directly extended to any other two or multiple objects that also can include the three basic elements, folding object 1 with pouch or pocket to an object 2 with tail (shown in FIG. 1).

The invention claimed is:

1. A method of interconnection of a plurality of toys comprising:

providing a first of said plurality of toys comprises a first closable body, a pocket on said closable body and a plurality of protrusions extending from said first closable body;

providing a second of said plurality of toys comprises a second body and an extension member having a first portion and a second portion wherein said second portion is larger than said first portion, wherein said first closable body is movable between an open position and a closed position and wherein said pocket is on an exterior surface of said first closable body when said first closable body is in said open position and said pocket is in an interior of said first closable body when said first closable body is in said closed position;

placing said second portion of said extension member of said second toy into said pocket of said first toy while said first closable body is in said open position with said pocket on an exterior surface of said first closable body; and closing said first closable body over a portion of said extension member of said second toy and over said pocket by moving said first closable body from said open position to said closed position to place said pocket in said interior of said first closable body.

2. A method of interconnection of a plurality of toys according to claim 1, further comprising:

folding said plurality of protrusions extending from said first body into said pocket around said second portion of said extension member of said second toy prior to closing said first body.

3. A method of interconnection of a plurality of toys according to claim 1, wherein said extension member of said second toy comprises a detachable tail.

4. A method of interconnection of a plurality of toys comprising:

providing a plurality of toys comprises a body having an open position and a closed position, a pocket, a protrusion extending from said body and an extension member having a first portion and a second portion wherein said second portion is larger than said first portion;

placing a second portion of an extension member of a second toy into a pocket of said first toy with a body of said first toy in an open position; and closing said first body of said first toy over said second portion of said extension member of said second toy and said pocket to fold said extension member of said second toy over on itself place said second toy on belay with said first toy.

5. A method of interconnection of a plurality of toys according to claim 4, further comprising:

after placing said second portion of said extension member of said second toy into said pocket of said first toy and before closing said body of said first toy, folding a protrusion extending from said body of said first toy into said pocket of said body of said first toy over said second portion of said extension member of said second toy.

6. A method of interconnection of a plurality of toys according to claim 4, further comprising:

placing a third portion of an extension member of a third toy into a pocket of said second toy;

folding a first protrusion of said first toy extending from said first body into said first pocket over said second portion of said extension member of said second toy;

closing said first body of said first toy over said second portion of said extension member of said second toy to place said second toy on belay with said first toy.

* * * * *